US007841734B2

(12) United States Patent
Wilcox

(10) Patent No.: US 7,841,734 B2
(45) Date of Patent: Nov. 30, 2010

(54) LED LIGHTING FIXTURE

(75) Inventor: Kurt S. Wilcox, Libertyville, IL (US)

(73) Assignee: Ruud Lighting, Inc., Racine, WI (US)

( * ) Notice: Subject to any disclaimer, the term of this patent is extended or adjusted under 35 U.S.C. 154(b) by 170 days.

(21) Appl. No.: 12/127,765

(22) Filed: May 27, 2008

(65) Prior Publication Data

US 2009/0296392 A1 Dec. 3, 2009

(51) Int. Cl.
*F21V 21/00* (2006.01)
*F21S 8/00* (2006.01)
*F21S 13/10* (2006.01)

(52) U.S. Cl. ..... 362/153; 362/249.01; 362/249.02; 362/235; 362/257; 362/317; 362/153.1; 362/431

(58) Field of Classification Search ..... 362/249.01, 362/249.02, 249.06, 235, 247, 294, 800, 362/373, 257, 317, 153, 153.1, 431
See application file for complete search history.

(56) References Cited

U.S. PATENT DOCUMENTS 1,029,404 A 6/1912 Schumacher
2,472,597 A 6/1949 Levy
2,534,955 A 12/1950 Dazley
2,534,956 A 12/1950 Pistey et al.
2,963,574 A 12/1960 Pfaff, Jr.
3,039,678 A 6/1962 Sharpe
3,145,934 A 8/1964 Guggemos
3,148,836 A 9/1964 Potye
3,191,087 A 6/1965 Sugiyama
3,218,446 A 11/1965 Langer
3,413,461 A 11/1968 Wince
3,673,403 A * 6/1972 Woods ..... 362/403
3,777,138 A 12/1973 Metzler
4,161,020 A 7/1979 Miller
4,225,905 A 9/1980 Moriyama et al.
4,225,909 A 9/1980 Scholz et al.
4,244,013 A 1/1981 Wotowiec
4,278,911 A 7/1981 Metoff
4,410,834 A 10/1983 Witte et al.
4,420,799 A 12/1983 Miller
4,498,125 A 2/1985 Schumaker
4,547,839 A 10/1985 Ripley et al.
4,549,252 A 10/1985 Ripley et al.
4,827,389 A 5/1989 Crum
4,974,138 A * 11/1990 Negishi ..... 362/347

(Continued)

OTHER PUBLICATIONS

Pages from Acuity Brands Lighting website. "Eurotique." Date: Copyright 2007. 10 pages.

(Continued)

*Primary Examiner*—Jacob Y Choi
(74) *Attorney, Agent, or Firm*—Jansson Shupe & Munger Ltd.

(57) ABSTRACT

An LED lighting fixture includes a support structure having a horizontal cross-dimension and a top structure attached to the support structure and extending outwardly beyond the support structure. The top structure has a bottom surface with peripheral portion surrounding a non-peripheral portion. A plurality of LED emitters are positioned on the peripheral portion for emitting light in downward direction substantially outside of the horizontal cross-dimension of the support structure.

17 Claims, 7 Drawing Sheets

U.S. PATENT DOCUMENTS

| | | | | |
|---|---|---|---|---|
| 5,134,550 | A | 7/1992 | Young | |
| 5,580,161 | A | 12/1996 | Vakil et al. | |
| 5,938,316 | A | 8/1999 | Yan | |
| 6,206,545 | B1 | 3/2001 | Yan | |
| D440,002 | S | 4/2001 | Miranda | |
| D444,584 | S | 7/2001 | Landefeld | |
| 6,398,384 | B2 * | 6/2002 | Siminovitch et al. | 362/225 |
| 6,439,740 | B1 | 8/2002 | Yan | |
| 6,443,592 | B1 | 9/2002 | Unger et al. | |
| D470,965 | S | 2/2003 | Landefeld | |
| 6,575,604 | B2 | 6/2003 | Liu | |
| 6,639,350 | B1 | 10/2003 | Sejkora | |
| D482,481 | S | 11/2003 | Landefeld | |
| 6,705,747 | B2 | 3/2004 | Caferro et al. | |
| 6,776,508 | B2 | 8/2004 | Bucher et al. | |
| 6,784,357 | B1 | 8/2004 | Wang | |
| D497,447 | S | 10/2004 | Yoneda | |
| 6,869,205 | B1 | 3/2005 | Yan | |
| D504,536 | S | 4/2005 | Emory et al. | |
| D529,218 | S | 9/2006 | Wen | |
| D529,653 | S | 10/2006 | Galipeau et al. | |
| D537,556 | S | 2/2007 | Summerford et al. | |
| 7,192,154 | B2 | 3/2007 | Becker | |
| D540,485 | S | 4/2007 | Waedeled | |
| 7,201,489 | B2 | 4/2007 | Shyu | |
| 7,221,271 | B2 * | 5/2007 | Reime | 340/541 |
| D553,779 | S | 10/2007 | Butler | |
| D556,357 | S | 11/2007 | Butler et al. | |
| D558,908 | S | 1/2008 | Waedeled | |
| D563,017 | S | 2/2008 | Waedeled | |
| 7,360,925 | B2 * | 4/2008 | Coushaine | 362/249.01 |
| 2004/0170022 | A1 | 9/2004 | Yoshimori et al. | |
| 2006/0105485 | A1 | 5/2006 | Basin et al. | |
| 2006/0256568 | A1 | 11/2006 | Ellis | |
| 2006/0285310 | A1 | 12/2006 | Shyu | |
| 2007/0159819 | A1 | 7/2007 | Bayat et al. | |
| 2007/0242450 | A1 | 10/2007 | Blatecky | |
| 2008/0013306 | A1 | 1/2008 | Guilmette | |
| 2008/0068799 | A1 | 3/2008 | Chan | |
| 2008/0089070 | A1 | 4/2008 | Wang | |
| 2009/0237934 | A1 * | 9/2009 | Zeng et al. | 362/249.03 |

OTHER PUBLICATIONS

Pages from www.bega-us.com website. "Bega." Date: Copyright 2005. 4 pages.

Pages from www.aal.net website. "Largent." Date: Copyright 2005. 13 pages.

Specification sheets from www.aal.net website. "Largent." Copyright 2005. 3 pages.

Excerpts from www.dewken.com website. Date: undated. 2 pages.

Excerpts of International Search Report and Written Opinion for PCT/US09/03199. Date: Jul. 14. 4 pages.

* cited by examiner

LED LIGHTING FIXTURE

FIELD OF THE INVENTION

This invention relates to light fixtures. More particularly, this invention relates to such light fixtures which utilize LEDs as light source.

BACKGROUND OF THE INVENTION

In recent years, the use of light-emitting diodes (LEDs) for various common lighting purposes has increased, and this trend has accelerated as advances have been made in LEDs and in LED-array bearing devices, often referred to as "LED modules." Indeed, lighting applications which have been served by fixtures using high-intensity discharge (HID) lamps and other light sources are now increasingly beginning to be served by LEDs modules. Such lighting applications include, among a good many others, roadway lighting, parking lot lighting and many other applications. Creative work continues in the field of using LEDs for light fixtures in various applications. It is the latter field to which this invention relates.

High-luminance light fixtures using LEDs as light source for outdoor applications present particularly challenging problems. High costs due to high complexity becomes a particularly difficult problem when high luminance, reliability, and durability are essential to product success. Keeping electronic LED drivers in a water/air-tight location may also be problematic, particularly when the light fixtures are constantly exposed to the elements and many LEDs are used.

Yet another challenge is the problem of achieving a high level of adaptability in order to meet a wide variety of different luminance requirements and satisfy a vide variety of applications. That is, providing a fixture which can be adapted to give significantly greater or lesser amounts of luminance in a desired direction as deemed appropriate for particular applications is a difficult problem. Light-fixture adaptability is an important goal for LED light fixtures.

Dealing with heat dissipation requirements is still another problem area for high-luminance LED light fixtures. Heal dissipation is difficult in part because high-luminance LED light fixtures typically have many LEDs. Complex structures for module mounting and heat dissipation have sometimes been deemed necessary, and all of this adds to complexity and cost.

In short, there is a significant need in the lighting industry for improved light fixtures and the like using LEDs. There is a need for fixtures that are adaptable for a wide variety of lighting situations, and that satisfy the problems associated with heat dissipation and appropriate protection of electronic LED driver components. Finally, there is a need for an improved LED-module-based light which is simple, and is easy and inexpensive to manufacture.

OBJECTS OF THE INVENTION

It is an object of the invention to provide an improved LED floodlight fixture that overcomes some of the problems and shortcomings of the prior art, including those referred to above.

Another object of the invention is to provide an improved LED lighting fixture that is readily adaptable for a variety of mounting positions and situations.

Another object of the invention is to provide an improved outdoor LED lighting fixture with excellent protection of the electronic LED drivers needed for such products.

Still another object of the invention is to provide an improved LED lighting fixture with both good protection of electronic LED drivers and excellent heat dissipation.

Yet another object of the invention is to provide and improved LED lighting fixture providing desirable direction for the illumination.

How these and other objects are accomplished will become apparent from the following descriptions and the drawings.

SUMMARY OF THE INVENTION

The present invention is an improvement in LED lighting fixture. The inventive LED lighting fixture includes a support structure which has a horizontal cross-dimension, a lop structure attached to the support structure and extending outwardly beyond the support structure, the top structure having a bottom surface with peripheral portion surrounding a non-peripheral portion, and a plurality of LED emitters positioned on the peripheral portion for emitting light in downward direction substantially outside of the horizontal cross-dimension of the support structure.

The LED emitters are preferably arranged in an annular configuration. In such embodiments, top structure is preferably circular. It is preferred that the top structure is concentric with the support structure.

In some preferred embodiments, the top structure has an outer perimeter which defines a greatest top-structure horizontal dimension. It is preferred that the greatest dimension between the bottom surface and an opposite surface is at least 50% smaller than the greatest top-structure horizontal dimension.

In most highly preferred embodiments of this invention, at least a subset of the emitters each have associated LED lenses configured for distributing light toward a preferential side off-axially with respect to each emitter axis.

In some of such most highly preferred embodiments, LED lens on each of the emitters of the subset is configured for off-axial light distribution toward a corresponding preferential side radially away from the horizontal cross-dimension of the support structure, thereby to widen an outward and downward illumination angle. In such embodiments, the LED lensing is configured to enlarge an area of illumination while having no more than minimal light directed onto the support structure.

In some other of such most highly preferred embodiments, the support structure has an upright lower portion of no more than the first horizontal cross-dimension and an upwardly/outwardly-extending upper portion. The top structure is attached to the upper portion. It is preferred that LED lenses on all of the emitters of the subset be configured for off-axial light distribution toward a common preferential side, thereby to facilitate illumination in a common downward lateral direction. LED lensing preferably includes at least one shield member positioned to intercept LED light emitted toward a non-preferential side.

In some preferred embodiments, the top structure includes a single-piece bottom member which defines the bottom surface and has a plurality of openings each aligned with its corresponding LED emitter, and a single-piece lop member which has an inner portion including a heat-sink arrangement aligned with the peripheral portion for transferring heat from the LED emitters outside the top member.

In some highly preferred embodiments, the top structure forms a substantially water/air-tight chamber. It is highly preferred that the fixture further include LED-supporting electronic device(s) enclosed within the chamber. The inner portion of the top member preferably includes a cavity surrounded by the heat-sink arrangement. The LED-supporting electronic device(s) is/are preferably positioned within the cavity.

In some of such highly preferred embodiments, the top structure includes a sensor device secured with respect to the non-peripheral portion of the bottom surface. The sensor devise may be a motion sensor or any other type of sensors which might be useful for the inventive lighting fixture in a desired application. It is most highly preferred that the sensor device is concentric with the top structure.

In certain preferred versions of the inventive LED lighting fixture, the support structure has an upright lower portion of no more than the first horizontal cross-dimension and an upwardly/outwardly-extending upper portion. The top structure is attached to the upper portion. It is highly preferred that the upwardly/outwardly-extending upper portion of the support structure is a single-piece member.

In such versions of the LED lighting fixture, the support structure is preferably mounted to a mounting surface. It is preferred that the lower end of the upwardly/outwardly-extending upper portion is adjacent to the mounting surface. These versions of the inventive lighting fixture are especially have a great flexibly for mounting locations. For example, such fixtures may be used as landscape light mounted at the ground level along a pathway, in the middle of a flowerbed, or any other desirable location.

The off-axial illumination of such fixture allows direction LED light toward one preferential side such as toward a walking path, a pond or an object at the ground. In such versions, the LED lenses may provide such light-distribution angle which directs light emitted from LEDs, which are at a position farthest from the preferential side, across the greatest top-structure horizontal dimension toward the preferential side through the upwardly/outwardly-extending upper portion with no more than minimal light directed onto the support structure lower portion or the ground immediately under the top structure. The upwardly/outwardly-extending upper portion is preferably positioned such that a fewest number upwardly/outwardly-extending arms and their minimal dimensions is/are in a way of the light.

Alternatively, if illumination of a wide landscape area is desired, the off-axial illumination would allow direction of LED light laterally and radially away from the support structure.

It should be noted that such versions of the LED lighting fixture are not limited to ground mounting. These version of the inventive lighting fixture may be mounted to a wall of a building to illuminate the wall surface. Such wall-mounting allows for both illumination of building exteriors and interiors to create desirable light pattern. It should be understood that positioning and orientation of the inventive LED lighting fixture is in no way limited to the shown embodiments and discussed examples.

The terms "downward" or "downwardly," which refer to a direction of LED-emitted light, is used to simplify understanding of the present invention and is in no way limited to the direction of gravity. These terms simply indicate that the LEDs are positioned to emit light directly away from their mounting surface toward illumination area; and that such LED-mounting surface, i.e., the bottom surface of the top structure, is substantially facing the illumination area.

Likewise, terms "top," "bottom," "lower," upper" and the like, which refer to elements of the inventive LED lighting fixture, are used to simplify naming of such elements and to indicate their positions with respect to each other, thus should not be limited to the direction of gravity.

In certain embodiments, LED-supporting electronic device(s) is/are enclosed within an interior of the support-structure.

In some embodiments of the certain preferred versions of the inventive LED lighting fixture, the upright lower portion of the support structure is a post, and the upwardly/outwardly-extending upper portion is secured on top of the post.

In such embodiments, the post may have a height from few inches to several feet. For example, the few-inch post allows mounting of the fixture with the upright lower portion adjacent to the mounting surface. In another example, the post may be about two and a half feet such that the inventive fixture is at a level of a typical bollard light. The positioning of LEDs for emitting light downwardly coupled with the LED lensing/off-axial light distribution provides a greater amount of luminance in a desired direction. Such greater luminance is achieved by avoiding loss of light that occurs in typical bollards which use reflectors for redirecting light from the inside of a cylindrical bollard housing. Yet in another example of a post-top lighting fixture in accordance with the present invention the post may be about eight-feet high. Such post-top fixtures may be positioned to illuminate walking paths, sidewalks or the like.

In some of such post-top embodiments, the LED-supporting electronic device(s) may be enclosed within the post interior. The upwardly/outwardly-extending upper portion preferably forms an enclosed wire-channel for wires extending from the top structure to the post interior.

DETAILED DESCRIPTION OF PREFERRED EMBODIMENTS

Figure 1:
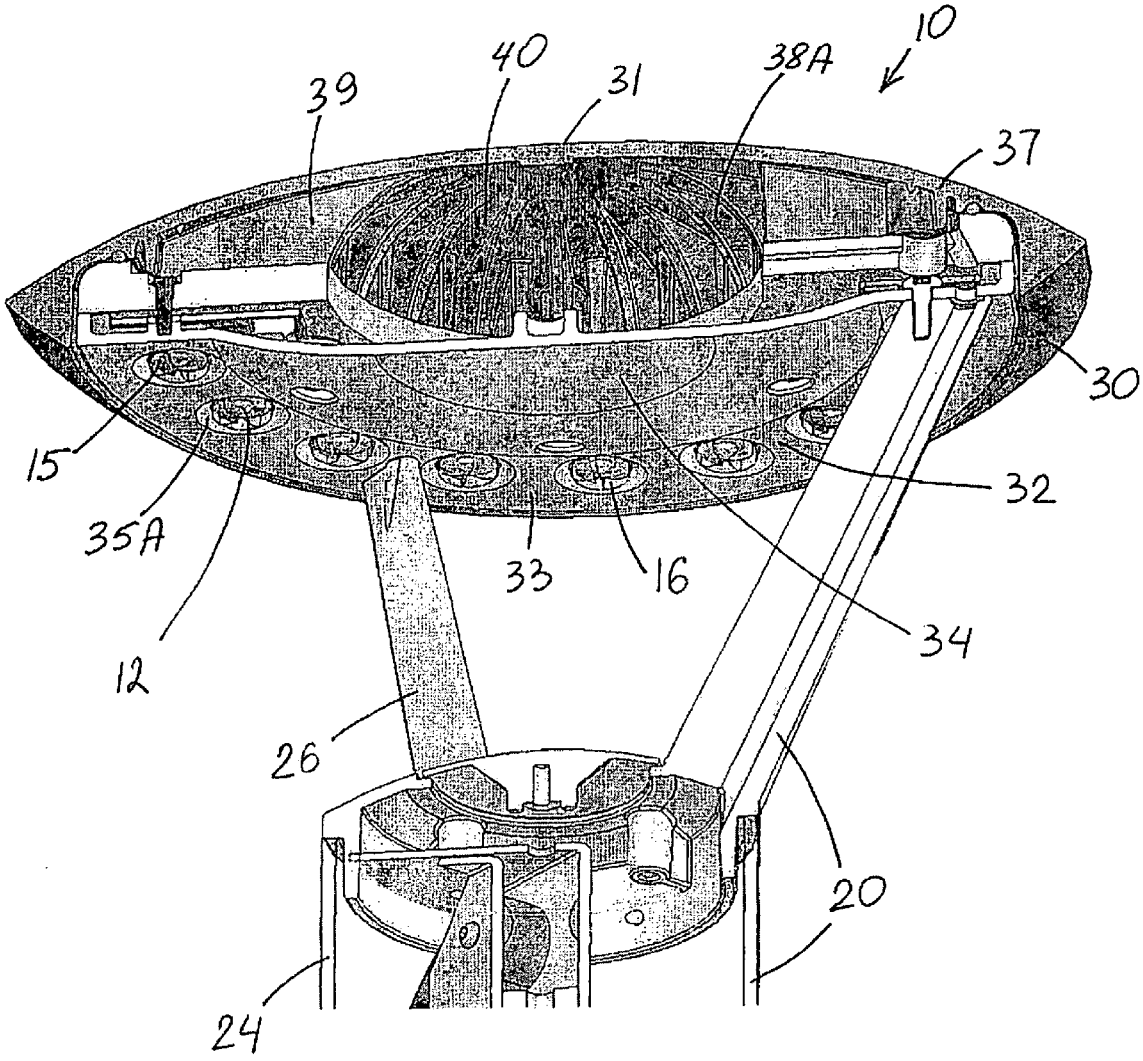
FIG. 1 is a perspective view of a preferred LED lighting fixture in accordance with this invention, including a cut-away portion showing an inner portion of the top member including a heat-sink aligned with an LED assembly.

FIGS. 1-9 illustrate preferred LED lighting fixture 10. The lighting fixture 10 includes a support structure 20 which has a horizontal cross-dimension 22, a top structure 30 attached to support structure 20 and extending outwardly beyond support structure 20. Top structure 30 has a bottom surface 32 with peripheral portion 33 surrounding a non-peripheral portion 34, and a plurality of LED emitters 12 positioned on peripheral portion 33 for emitting light in downward direction substantially outside of horizontal cross-dimension 22 of support structure 20.

Figure 2:
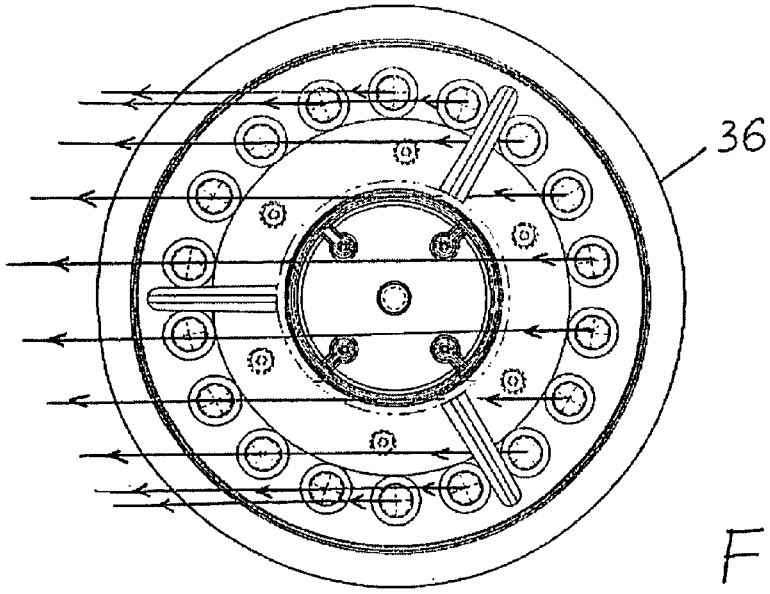
FIG. 2 is a plan view of the LED lighting fixture showing illumination in a common lateral direction.
Figure 4:
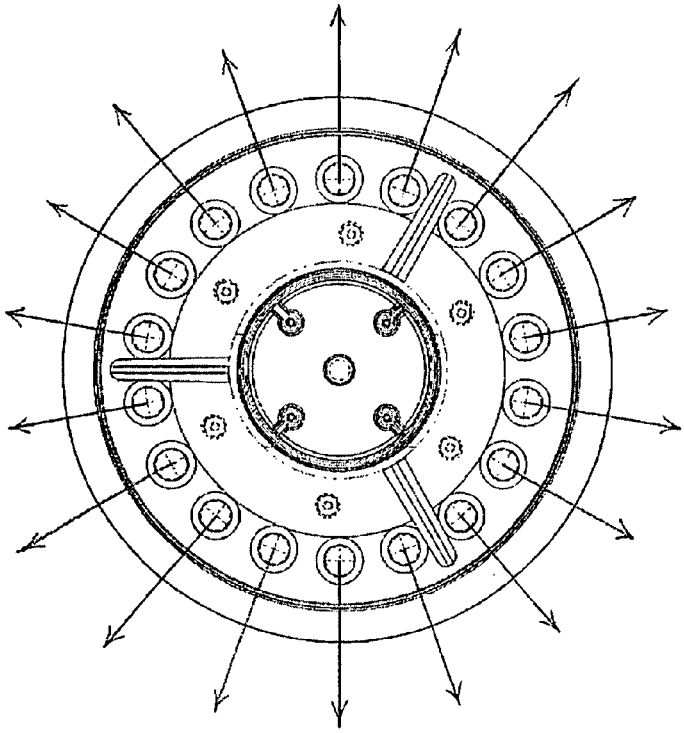
FIG. 4 is a plan view of the LED lighting fixture showing illumination radially away from the lower portion of the support structure.

As best seen in FIGS. 1, 2 and 4, LED emitters 12 are arranged in an annular configuration. These FIGURES further show that top structure 30 is circular. FIGS. 2 and 4 show that top structure 30 is concentric with support structure 20.

FIGS. 3, 5, 7 and 9 show that top structure 30 has an outer perimeter 36 which defines a greatest top-structure horizontal dimension 36A. The greatest dimension 37 between bottom surface 32 and an opposite surface 31 is at least 50% smaller than greatest top-structure horizontal dimension 36A.

FIGS. 1-4 best illustrate emitters 12 each having associated LED lensing 16 configured for off-axial light distribution toward a preferential side 17.

Figure 5:
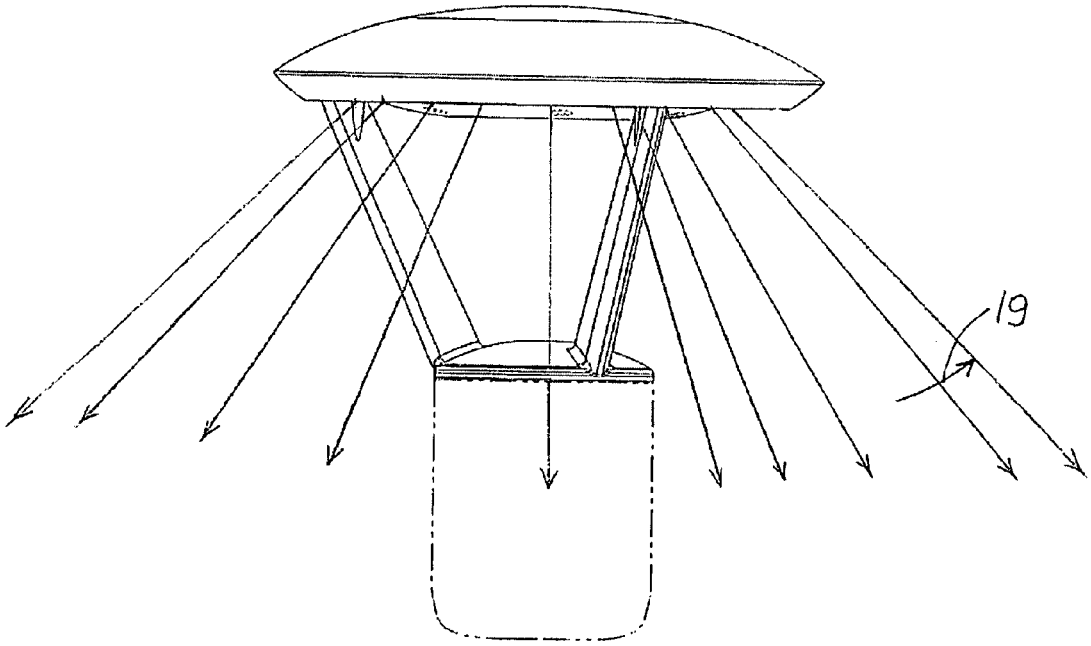
FIG. 5 is a side view of the LED lighting fixture showing illumination radially away from the lower portion of the support structure as in FIG. 4.

FIGS. 4 and 5 show LED lensing 16 on each of the emitters 12 configured for off-axial light distribution toward a corresponding preferential side radially away from horizontal cross-dimension 22 of support structure 20, thereby to widen an outward and downward illumination angle 19. As seen in these figures, LED lensing 16 is configured to enlarge an area of illumination while having no more than minimal light directed onto support structure 20.

FIGS. 1-5 and 7-9 show that support structure 20 has an upright lower portion 24 of no more than first horizontal cross-dimension 22 and an upwardly/outwardly-extending upper portion 26. FIGS. 1, 3, 5, 7 and 9 show top structure 30 is attached to upper portion 26.

Figure 3:
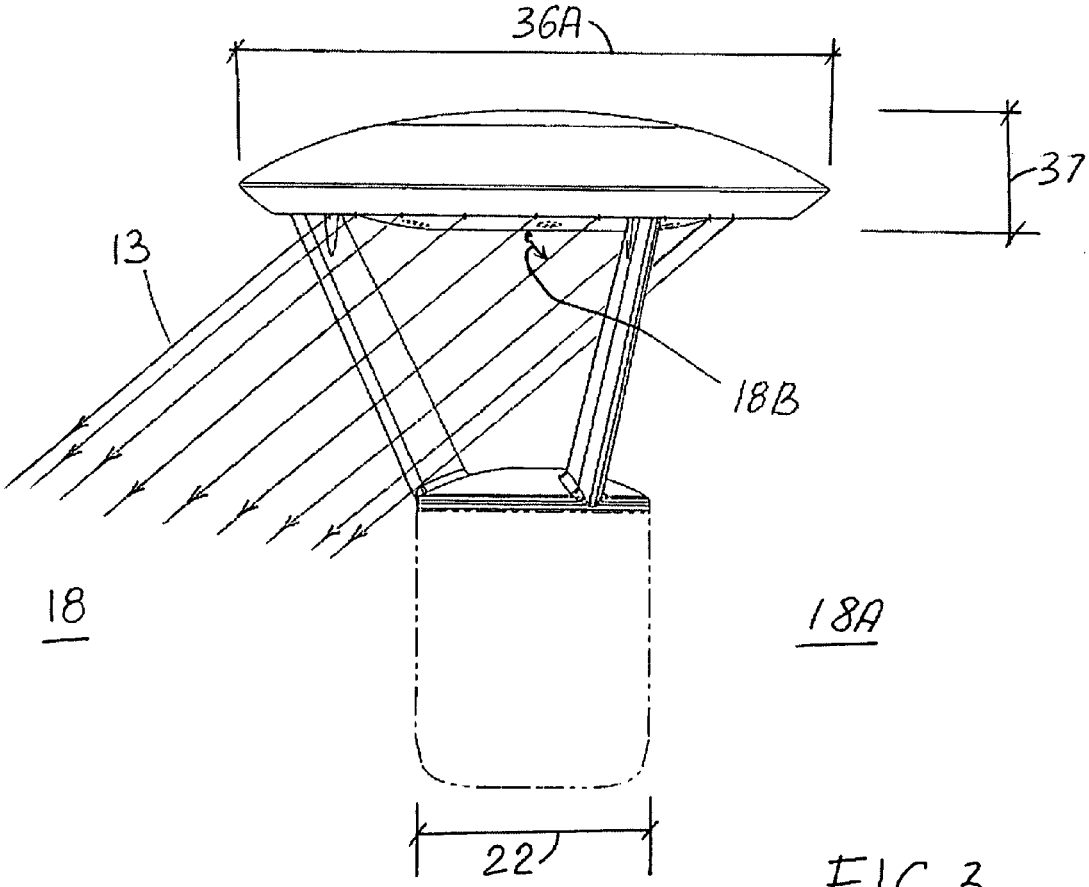
FIG. 3 is a side view of the LED lighting fixture showing illumination in a common lateral direction as in FIG. 2.

FIGS. 2 and 3 best show LED lensing 16 on all of emitters 12 configured for off-axial light distribution toward a common preferential side 18, thereby to facilitate illumination in a common downward lateral direction. As seen in FIG. 1, LED lensing 16 includes at least one shield member 15 positioned to intercept LED light 13 emitted toward non-preferential side 18A.

Top structure 30 includes a single-piece bottom member 35 and a single-piece top member 38. Single-piece bottom member 35 defines bottom surface 32 and has a plurality of openings 35A each aligned with its corresponding LED emitter 12. Single-piece top member 38 has an inner portion 38A including a heat-sink arrangement 39 aligned with peripheral portion 33 for transferring heat from LED emitters 12 outside top member 30.

Figure 6:
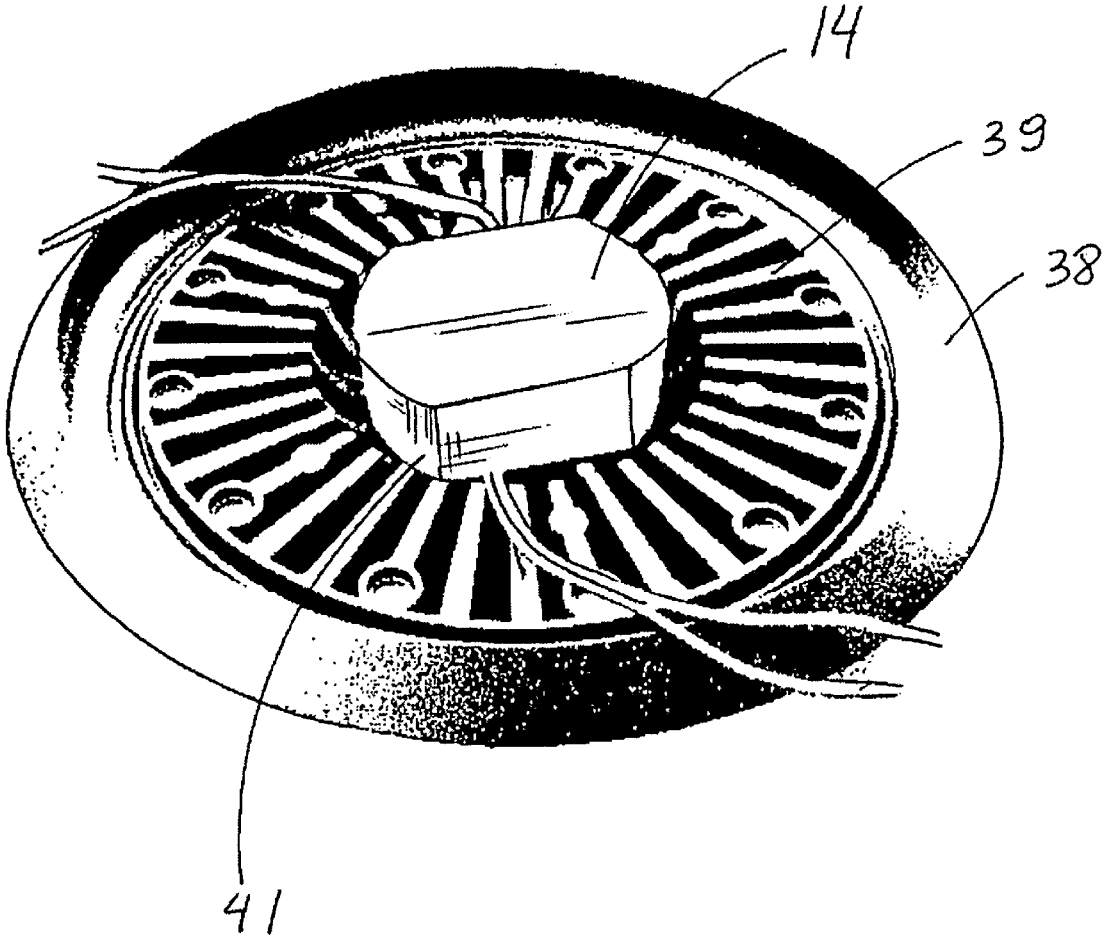
FIG. 6 is a perspective view from below of the top member showing the inner portion with a cavity surrounded by the heat-sink arrangement and LED-supporting electronic device within the cavity.

Top structure 30 forms a substantially water/air-tight chamber 40. FIG. 6 shows LED-supporting electronic device 14 enclosed within chamber 40. Inner portion 38A of top member 38 includes a cavity 41 surrounded by heat-sink arrangement 39. LED-supporting electronic device 14 is positioned within cavity 41.

Figure 9:
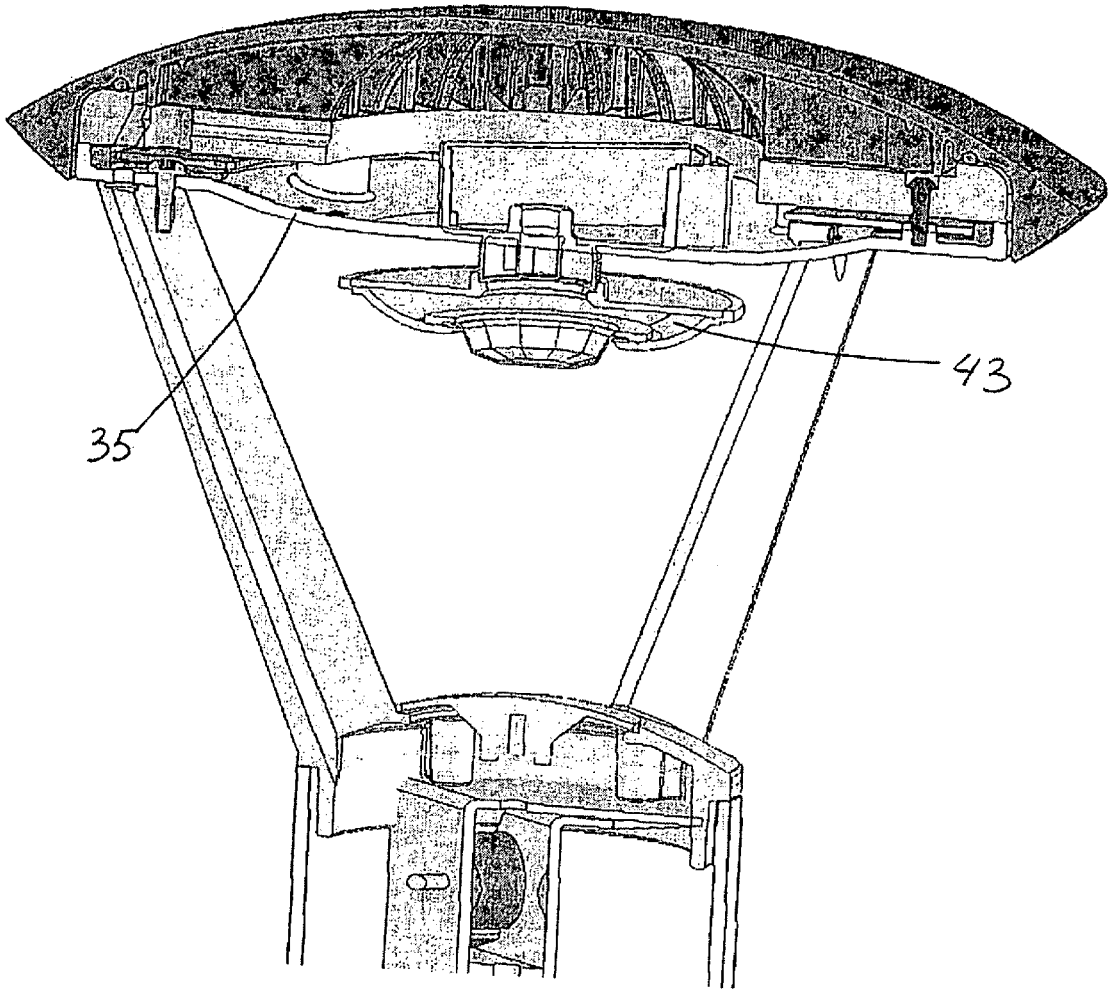
FIG. 9 is a side view of an embodiments of the LED lighting fixture with a sensor device secured to the bottom surface of the top structure.

FIG. 9 illustrates top structure 30 which includes a sensor device 43 secured to non-peripheral portion 34 of bottom surface 32. Sensor device 43 is concentric with top structure 30.

Figure 8:
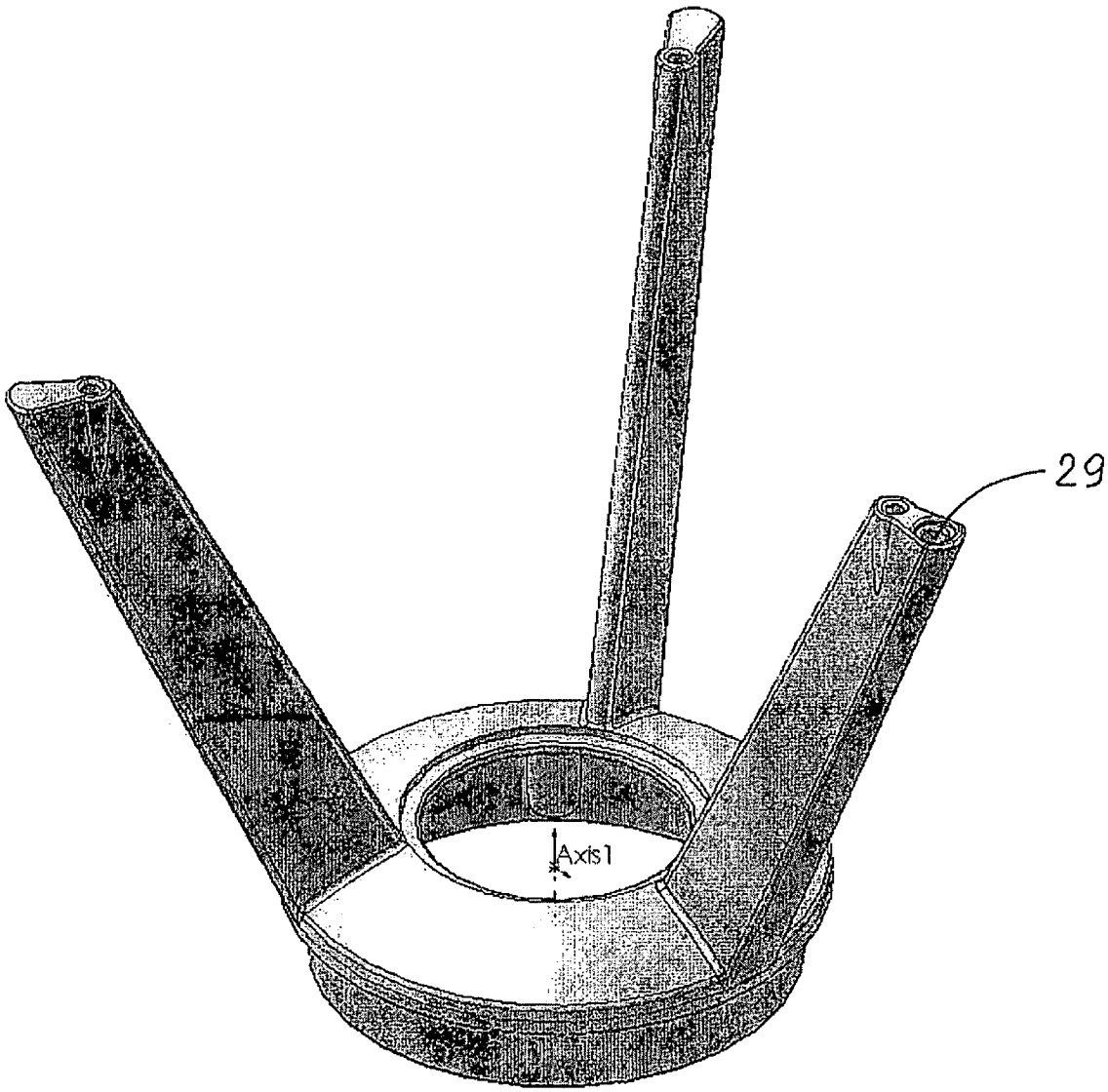
FIG. 8 is a perspective view from above of the single-piece upwardly/outwardly-extending upper portion of the support structure.

FIG. 8 best illustrates upwardly/outwardly-extending upper portion 26 of support structure 20 being a single-piece member.

As best shown in FIGS. 2 and 3 the off-axial illumination of fixture 10 allows direction of LED light toward one preferential side 17. LED lensing 16 provide such light-distribution angle 17B across greatest top-structure horizontal dimension 36A toward preferential side 17 through upwardly/outwardly-extending upper portion 26 with no more than minimal light directed onto support-structure lower portion 24. FIG. 3 shows upwardly/outwardly-extending upper portion 26 positioned such that only one upwardly/outwardly-extending arm and its minimal dimension is in a way of light 13.

FIGS. 4 and 5 show an alternative illumination of a wide area with off-axial illumination directing LED light 13 laterally and radially away from support structure 20.

FIGS. 1, 3, 5, 7 and 9 show that upright lower portion 24 of support structure 20 is a post 28, and upwardly/outwardly-extending upper portion 26 is secured on top of post 28.

Figure 7:
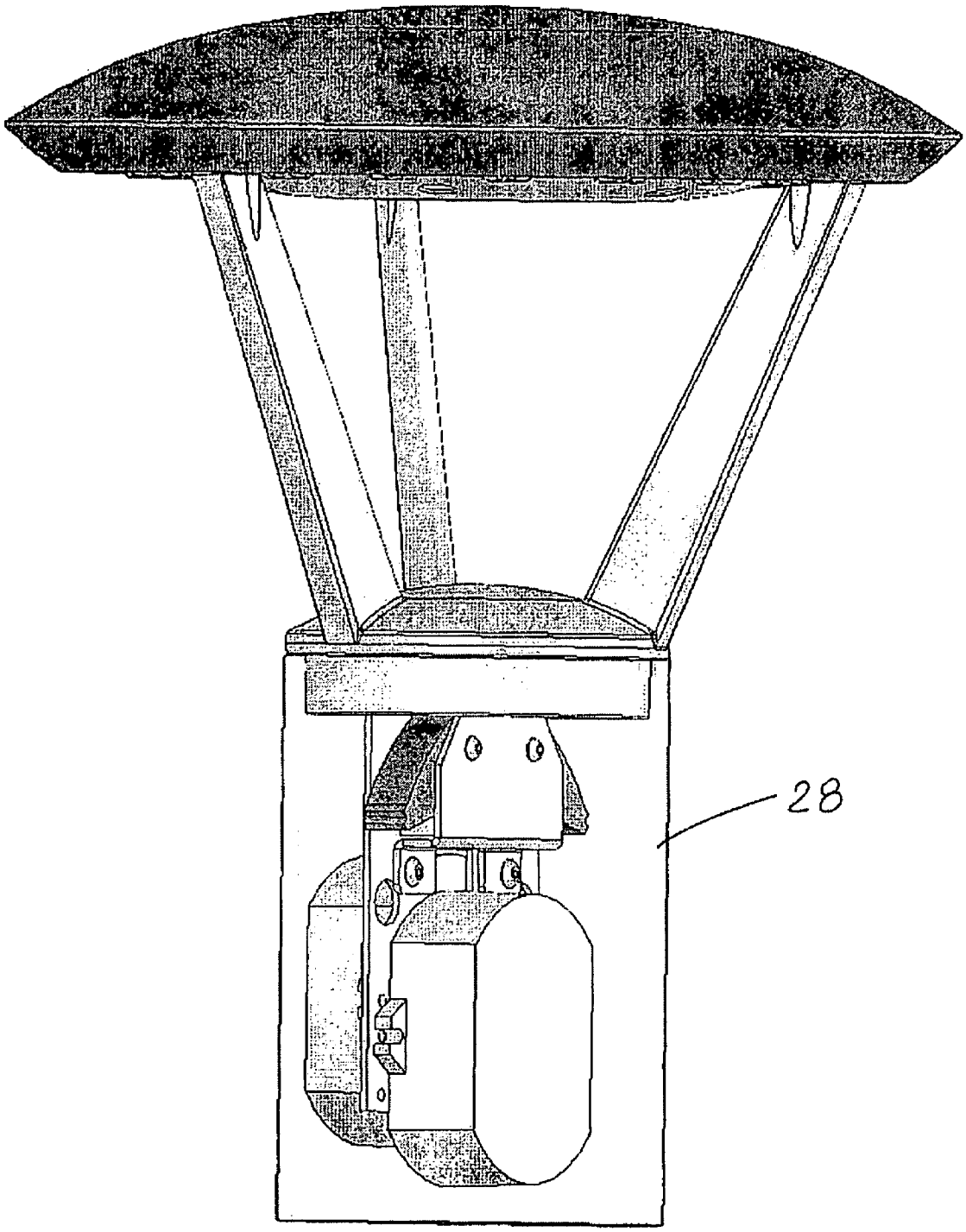
FIG. 7 is a side view of a post-top LED lighting fixture showing LED-supporting electronic devices enclosed within the post interior.

FIG. 7 illustrates LED-supporting electronic devices 14 enclosed within an interior of support-structure 20. As best seen in FIG. 8, upwardly/outwardly-extending upper portion 26 forms an enclosed wire-channel 29 for wires extending from top structure 30 to the post interior.

While the principles of the invention have been shown and described in connection with specific embodiments, it is to be understood that such embodiments are by way of example and are not limiting.

The invention claimed is:

1. An LED lighting fixture including:

a support structure having a horizontal cross-dimension and including an upwardly/outwardly-extending upper portion;

a top structure attached to the upper portion of the support structure coaxially therewith and extending outwardly beyond the support structure, the top structure having a bottom surface facing the support structure and having a peripheral portion which is substantially perpendicular to the support-structure axis and surrounds a non-peripheral portion;

a plurality of LED emitters positioned on the peripheral portion in an annular configuration for emitting light in downward direction substantially outside of the horizontal cross-dimension of the support structure and having no more than minimal light onto the support structure which upper portion being formed by at least one upwardly/outwardly-extending arm positioned with its minimal dimensions in a way of the light such that the upper portion of the support structure permits a through passage of light directed across the greatest top-structure horizontal dimension toward the preferential side from LED emitters positioned farthest therefrom; and at least a subset of the emitters each having associated LED lensing configured for distribution of light from the emitter in off-axial direction with respect to the emitter axis toward a preferential side, thereby to widen an outward and downward illumination angle or to facilitate illumination in a common downward lateral direction.

2. The LED lighting fixture of claim 1 wherein the top structure is circular.

3. The LED lighting fixture of claim 1 wherein:

the top structure has an outer perimeter defining a greatest top-structure horizontal dimension; and a greatest dimension between the bottom surface and an opposite surface is at least 50% smaller than the greatest top-structure horizontal dimension.

4. The LED lighting fixture of claim 1 wherein LED-supporting electronic device(s) is/are enclosed within an interior of the support structure.

5. The LED lighting fixture of claim 1 wherein LED lenses on each of the emitters of the subset are configured for off-axial light distribution toward a corresponding preferential side radially away from the lower portion of the support structure, thereby to widen and outward and downward illumination angle.

6. The LED lighting fixture of claim 1 wherein the support structure has an upright lower portion of no more than the first horizontal cross-dimension.

7. The LED lighting fixture of claim 6 wherein LED lenses on all of the emitters of the subset are configured for off-axial light distribution toward a common preferential side, thereby to facilitate illumination in a common downward lateral direction.

8. The LED lighting fixture of claim 7 wherein the LED lenses include at least one shield member positioned to intercept LED light emitted toward a non-preferential side.

9. The LED lighting fixture of claim 1 wherein the top structure includes:

a single-piece bottom member defining the bottom surface and having a plurality of openings each aligned with its corresponding LED emitter; and a single-piece top member having an inner portion including a heat-sink arrangement aligned with the peripheral portion for transferring heat from the LED emitters outside the top member.

10. The LED lighting fixture of claim 9 wherein the top structure forms a substantially water/air-tight chamber, and the fixture further includes LED-supporting electronic device (s) enclosed within the chamber.

11. The LED lighting fixture of claim 10 wherein the inner portion of the top member includes a cavity surrounded by the heat-sink arrangement, whereby the LED-supporting electronic device(s) is/are positioned within the cavity.

12. The LED lighting fixture of claim 11 wherein the top structure further includes a sensor device secured with respect to the non-peripheral portion of the bottom surface.

13. The LED lighting fixture of claim 1 wherein the support structure has an upright lower portion of no more than the first horizontal cross-dimension.

14. The LED lighting fixture of claim 13 wherein the upwardly/outwardly-extending upper portion of the support structure is a single-piece member.

15. The LED lighting fixture of claim 13 wherein: the support structure is mounted to a mounting surface; and the lower end of the upwardly/outwardly-extending upper portion is adjacent to the mounting surface.

16. The LED lighting fixture of claim 13 wherein the upright lower portion of the support structure is a post, and the upwardly/outwardly-extending upper portion is secured on top of the post.

17. The LED lighting fixture of claim 1 wherein the upper portion of the support structure is a set of upwardly/outwardly-extending arms positioned with their minimal dimensions in a way of the light.

* * * * *

UNITED STATES PATENT AND TRADEMARK OFFICE

CERTIFICATE OF CORRECTION

PATENT NO. : 7,841,734 B2
APPLICATION NO. : 12/127765
DATED : November 30, 2010
INVENTOR(S) : Kurt S. Wilcox It is certified that error appears in the above-identified patent and that said Letters Patent is hereby corrected as shown below:

In the Specification

In column 1, line 34, the word “vide” should be --wide--.
In column 1, line 41, the word “Heal” should be --Heat--.
In column 2, line 4, the word “and” should be --an--.
In column 2, line 14, the word “lop” should be --top--.
In column 2, line 59, the word “lop” should be --top--.
In column 2, line 65, the word “include” should be --includes--.
In column 4, line 56, the word “embodiments” should be --embodiment--.

Signed and Sealed this
Second Day of June, 2015

Michelle K. Lee

Michelle K. Lee
*Director of the United States Patent and Trademark Office*